US011257462B2

(12) United States Patent
Hong et al.

(10) Patent No.: US 11,257,462 B2
(45) Date of Patent: Feb. 22, 2022

(54) DISPLAY DEVICE, A METHOD OF GENERATING COMPENSATION DATA FOR A DISPLAY DEVICE, AND A METHOD OF OPERATING A DISPLAY DEVICE

(71) Applicant: Samsung Display Co., Ltd., Yongin-si (KR)

(72) Inventors: Seok Ha Hong, Seoul (KR); Dong Joon Kwag, Seongnam-si (KR); Hyung Jin Kim, Seoul (KR); Ji-Eun Park, Hwaseong-si (KR); Hye-Sang Park, Cheonan-si (KR); Hyun Seuk Yoo, Seoul (KR); Hee Chui Hwang, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/928,463

(22) Filed: Jul. 14, 2020

(65) Prior Publication Data

US 2021/0125577 A1 Apr. 29, 2021

(30) Foreign Application Priority Data

Oct. 28, 2019 (KR) ..... 10-2019-0134512

(51) Int. Cl.
*G09G 5/02* (2006.01)

(52) U.S. Cl.
CPC ..... *G09G 5/02* (2013.01); *G09G 2320/0242* (2013.01); *G09G 2360/16* (2013.01)

(58) Field of Classification Search
CPC ..... G09G 5/02; G09G 2360/16; G09G 2320/0242
See application file for complete search history.

(56) References Cited

U.S. PATENT DOCUMENTS

2018/0308452 A1* 10/2018 Zhang ..... G09G 3/2003
2018/0374412 A1* 12/2018 Kaneko ..... G09F 9/30

FOREIGN PATENT DOCUMENTS

KR 10-2016-0053051 A 5/2016
KR 20170067925 A * 6/2017 ..... G09G 3/2003

* cited by examiner

*Primary Examiner* — Sahlu Okebato
(74) *Attorney, Agent, or Firm* — Lewis Roca Rothgerber Christie LLP

(57) ABSTRACT

In a method of generating compensation data for a display device, first color, second color, and third color compensation value sets may be obtained by capturing first color, second color, and third color images displayed by the display device, respectively, white, first color, second color, and third color loading luminances may be obtained by capturing white, first color, second color, and third color loading patterns displayed by the display device, respectively, first color, second color, and third color scale factors may be calculated by dividing a luminance decrease ratio of the white loading luminance by luminance decrease ratios of the first color, second color, and third color loading luminances, respectively, and the first color, second color, and third color compensation value sets and the first color, second color, and third color scale factors may be stored in the display device.

20 Claims, 10 Drawing Sheets

FIG. 5

W(R/G/B) LUMINANCE DECREASE RATIO
= W(R/G/B) BACKGROUND LUMINANCE DIFFERENCE
/ BLACK BACKGROUND LUMINANCE

R(G/B) SCALE FACTOR
= W LUMINANCE DECREASE RATIO
/ R(G/B) LUMINANCE DECREASE RATIO

510

| | | BACKGROUND | | | | |
|---|---|---|---|---|---|---|
| | POSITIOIN | BLACK | WHITE | RED | GREEN | BLUE |
| LUMINANCE | RP1 | 300 | 290 | 298 | 299 | 293 |
| | RP2 | 300 | 290 | 298 | 299 | 293 |
| | RP3 | 300 | 290 | 298 | 299 | 293 |
| | RP4 | 300 | 280 | 296 | 298 | 286 |
| | RP5 | 300 | 280 | 296 | 298 | 286 |
| | RP6 | 300 | 280 | 296 | 298 | 286 |
| | RP7 | 300 | 270 | 294 | 297 | 279 |
| | RP8 | 300 | 270 | 294 | 297 | 279 |
| | RP9 | 300 | 270 | 294 | 297 | 279 |

530

| | | BACKGROUND | | | | |
|---|---|---|---|---|---|---|
| | POSITIOIN | BLACK | WHITE | RED | GREEN | BLUE |
| LUMINANCE DECREASE RATIO | RP1 | 0.0% | 3.3% | 0.7% | 0.3% | 2.3% |
| | RP2 | 0.0% | 3.3% | 0.7% | 0.3% | 2.3% |
| | RP3 | 0.0% | 3.3% | 0.7% | 0.3% | 2.3% |
| | RP4 | 0.0% | 6.7% | 1.3% | 0.7% | 4.7% |
| | RP5 | 0.0% | 6.7% | 1.3% | 0.7% | 4.7% |
| | RP6 | 0.0% | 6.7% | 1.3% | 0.7% | 4.7% |
| | RP7 | 0.0% | 10.0% | 2.0% | 1.0% | 7.0% |
| | RP8 | 0.0% | 10.0% | 2.0% | 1.0% | 7.0% |
| | RP9 | 0.0% | 10.0% | 2.0% | 1.0% | 7.0% |

550

| | | BACKGROUND | | | | |
|---|---|---|---|---|---|---|
| | POSITIOIN | BLACK | WHITE | RED | GREEN | BLUE |
| SCALE FACTOR | RP1 | - | 1.0 | 5 | 10 | 1.4 |
| | RP2 | - | 1.0 | 5 | 10 | 1.4 |
| | RP3 | - | 1.0 | 5 | 10 | 1.4 |
| | RP4 | - | 1.0 | 5 | 10 | 1.4 |
| | RP5 | - | 1.0 | 5 | 10 | 1.4 |
| | RP6 | - | 1.0 | 5 | 10 | 1.4 |
| | RP7 | - | 1.0 | 5 | 10 | 1.4 |
| | RP8 | - | 1.0 | 5 | 10 | 1.4 |
| | RP9 | - | 1.0 | 5 | 10 | 1.4 |

FIG. 7

710

| | POSITIOIN | WHITE | RED | GREEN | BLUE |
|---|---|---|---|---|---|
| COMPENSATION VALUE | RP1 | 0.88 | 0.976 | 0.988 | 0.916 |
| | RP2 | 0.93 | 0.986 | 0.993 | 0.951 |
| | RP3 | 0.96 | 0.992 | 0.996 | 0.972 |
| | RP4 | 0.99 | 0.998 | 0.999 | 0.993 |
| | RP5 | 1 | 1 | 1 | 1 |
| | RP6 | 1.01 | 1.002 | 1.001 | 1.007 |
| | RP7 | 1.04 | 1.008 | 1.004 | 1.028 |
| | RP8 | 1.07 | 1.014 | 1.007 | 1.049 |
| | RP9 | 1.12 | 1.024 | 1.012 | 1.084 |

730

| | POSITIOIN | WHITE | RED | GREEN | BLUE |
|---|---|---|---|---|---|
| SCALE FACTOR APPLIED COMPENSATION VALUE | RP1 | 0.88 | 0.88 | 0.88 | 0.88 |
| | RP2 | 0.93 | 0.93 | 0.93 | 0.93 |
| | RP3 | 0.96 | 0.96 | 0.96 | 0.96 |
| | RP4 | 0.99 | 0.99 | 0.99 | 0.99 |
| | RP5 | 1 | 1 | 1 | 1 |
| | RP6 | 1.01 | 1.01 | 1.01 | 1.01 |
| | RP7 | 1.04 | 1.04 | 1.04 | 1.04 |
| | RP8 | 1.07 | 1.07 | 1.07 | 1.07 |
| | RP9 | 1.12 | 1.12 | 1.12 | 1.12 |

DISPLAY DEVICE, A METHOD OF GENERATING COMPENSATION DATA FOR A DISPLAY DEVICE, AND A METHOD OF OPERATING A DISPLAY DEVICE

CROSS-REFERENCE TO RELATED APPLICATION

This application claims priority to and the benefit of Korean Patent Application No. 10-2019-0134512, filed on Oct. 28, 2019 in the Korean Intellectual Property Office (KIPO), the disclosure of which is incorporated herein by reference in its entirety.

BACKGROUND

1. Field

Example embodiments of the present disclosure relate to a display device, a method of generating compensation data for a display device by considering a loading effect, and a method of operating a display device.

2. Description of the Related Art

Even if a plurality of pixels included in a display device is manufactured by the same process, the plurality of pixels may have different luminances due to a process variation, or the like, and thus a mura defect may occur in the display device. To reduce or eliminate the mura defect, and to improve luminance uniformity of the display device, red, green, and blue images displayed by the display device may be respectively captured, and red, green, and/or blue compensation data may be generated based on the captured images. The display device may compensate image data based on the red, green, and/or blue compensation data, and may display an image based on the compensated image data, thereby displaying each of the respective single color images (e.g., a red single color image, a green single color image, or a blue single color image) with uniform luminance (or substantially uniform luminance) and without the mura defect (or with substantially reduced mura defect).

However, the red, green, and blue compensation data may be generated respectively based on the captured red, green, and blue images without considering a loading effect, and thus a color deviation between a red color, a green color, and a blue color may be caused by the loading effect in a mixed color image having two or more of the red color, the green color, or the blue color, in particular in a high gray mixed color image.

SUMMARY

Aspects of some example embodiments are directed toward a method of generating compensation data for a display device capable of reducing or preventing a color deviation in a mixed color image.

Aspects of some example embodiments of the present disclosure are directed toward a method of operating a display device capable of reducing or preventing a color deviation in a mixed color image.

Aspects of some example embodiments provide a display device capable of reducing or preventing a color deviation in a mixed color image.

According to some example embodiments of the present disclosure, there is provided a method of generating compensation data for a display device. In the method, first color, second color, and third color compensation value sets are obtained by capturing first color, second color, and third color images displayed by the display device, respectively, white, first color, second color, and third color loading luminances are obtained by capturing white, first color, second color, and third color loading patterns displayed by the display device, respectively, first color, second color, and third color scale factors are calculated by dividing a luminance decrease ratio of the white loading luminance by luminance decrease ratios of the first color, second color, and third color loading luminances, respectively, and the first color, second color, and third color compensation value sets and the first color, second color, and third color scale factors are stored in the display device. The first color, second color, and third color scale factors are selectively utilized in compensating input image data of the display device according to whether the input image data represents a single color image or a mixed color image.

In some example embodiments, to obtain the white, first color, second color, and third color loading luminances, the white loading luminance may be obtained by capturing a white image as the white loading pattern, the first color loading luminance at a reference position may be obtained by capturing, as the first color loading pattern, an image having a first color background and a white portion at the reference position, the second color loading luminance at the reference position may be obtained by capturing, as the second color loading pattern, an image having a second color background and the white portion at the reference position, and the third color loading luminance at the reference position may be obtained by capturing, as the third color loading pattern, an image having a third color background and the white portion at the reference position.

In example embodiments, the first color, second color, and third color loading luminances may be obtained at a plurality of reference positions including the reference position.

In some example embodiments, the first color loading luminance at the plurality of reference positions may be obtained by sequentially capturing a plurality of images having the first color background and respectively having a plurality of white portions at the plurality of reference positions, the second color loading luminance at the plurality of reference positions may be obtained by sequentially capturing a plurality of images having the second color background and respectively having the plurality of white portions at the plurality of reference positions, and the third color loading luminance at the plurality of reference positions may be obtained by sequentially capturing a plurality of images having the third color background and respectively having the plurality of white portions at the plurality of reference positions.

In some example embodiments, the first color loading luminance at the plurality of reference positions may be obtained by capturing a single image having the first color background and a plurality of white portions at the plurality of reference positions, the second color loading luminance at the plurality of reference positions may be obtained by capturing a single image having the second color background and the plurality of white portions at the plurality of reference positions, and the third color loading luminance at the plurality of reference positions may be obtained by capturing a single image having the third color background and the plurality of white portions at the plurality of reference positions.

In some example embodiments, a black loading luminance may be obtained by capturing a black loading pattern. To calculate the first color, second color and third color scale factors, the luminance decrease ratio of the white loading luminance may be calculated by dividing a difference between the white loading luminance and the black loading luminance by the black loading luminance, the luminance decrease ratio of the first color loading luminance may be calculated by dividing a difference between the first color loading luminance and the black loading luminance by the black loading luminance, the luminance decrease ratio of the second color loading luminance may be calculated by dividing a difference between the second color loading luminance and the black loading luminance by the black loading luminance, the luminance decrease ratio of the third color loading luminance may be calculated by dividing a difference between the third color loading luminance and the black loading luminance by the black loading luminance, the first color scale factor may be calculated by dividing the luminance decrease ratio of the white loading luminance by the luminance decrease ratio of the first color loading luminance, the second color scale factor may be calculated by dividing the luminance decrease ratio of the white loading luminance by the luminance decrease ratio of the second color loading luminance, and the third color scale factor may be calculated by dividing the luminance decrease ratio of the white loading luminance by the luminance decrease ratio of the third color loading luminance.

In some example embodiments, the first color, second color and third color scale factors may be obtained at a plurality of reference positions.

In some example embodiments, the white, first color, second color, and third color loading luminances may be obtained at a maximum gray level, and the first color, second color, and third color scale factors may be obtained at the maximum gray level.

In some example embodiments, the white, first color, second color, and third color loading luminances may be obtained at entire gray levels used in the display device, and the first color, second color, and third color scale factors may be obtained at the entire gray levels.

In some example embodiments, the white, first color, second color, and third color loading luminances may be obtained at a plurality of reference gray levels that is a portion of entire gray levels used in the display device, and the first color, second color, and third color scale factors may be obtained at the plurality of reference gray levels.

In some example embodiments, when the input image data represents the single color image, the input image data may be compensated using the first color, second color, and third color compensation value sets to which the first color, second color, and third color scale factors are not applied. When the input image data represents the mixed color image, the input image data may be compensated using the first color, second color, and third color compensation value sets to which the first color, second color, and third color scale factors are respectively applied.

In some example embodiments, the first color, second color, and third color scale factors may be applied to the first color, second color and third color compensation value sets by using an equation, "FINAL_COMP_VAL=1−((1−COMP_VAL)*SCALE_FACTOR)", where COMP_VAL represents a compensation value in a corresponding one of the first color, second color, and third color compensation value sets, SCALE_FACTOR represents a corresponding one of the first color, second color, and third color scale factors, and FINAL_COMP_VAL represents the compensation value to which the corresponding one of the first color, second color, and third color scale factors is applied.

According to some example embodiments, there is provided a method of operating a display device. In the method, first color, second color, and third color compensation value sets and first color, second color, and third color scale factors are stored, input image data is received, whether the input image data represents a single color image or a mixed color image is determined, output image data is generated by compensating the input image data using the first color, second color, and third color compensation value sets to which the first color, second color, and third color scale factors are not applied when the input image data represents the single color image, the output image data is generated by compensating the input image data using the first color, second color, and third color compensation value sets to which the first color, second color, and third color scale factors are respectively applied when the input image data represents the mixed color image, and an image is displayed based on the output image data.

In some example embodiments, to determine whether the input image data represents the single color image or the mixed color image, it may be determined that the input image data represents the single color image when the input image data includes single color pixel data with respect to pixels of which a number is greater than or equal to a reference number, and it may be determined that that the input image data represents the mixed color image when the input image data includes the single color pixel data with respect to pixels of which a number is less than the reference number.

In some example embodiments, white, first color, second color, and third color loading luminances may be obtained by capturing white, first color, second color, and third color loading patterns displayed by the display device, respectively, and the first color, second color, and third color scale factors may be calculated by dividing a luminance decrease ratio of the white loading luminance by luminance decrease ratios of the first color, second color, and third color loading luminances, respectively.

In some example embodiments, the first color, second color, and third color scale factors may be applied to the first color, second color, and third color compensation value sets by using an equation, "FINAL_COMP_VAL=1−((1−COMP_VAL)*SCALE_FACTOR)", where COMP_VAL represents a compensation value in a corresponding one of the first color, second color, and third color compensation value sets, SCALE_FACTOR represents a corresponding one of the first color, second color, and third color scale factors, and FINAL_COMP_VAL represents the compensation value to which the corresponding one of the first color, second color, and third color scale factors is applied.

According to some example embodiments, there is provided a display device including a display panel including a plurality of pixels, a data driver configured to provide data signals corresponding to output image data to the plurality of pixels, a scan driver configured to provide scan signals to the plurality of pixels, a compensation data storage configured to store first color, second color, and third color compensation value sets and first color, second color, and third color scale factors, and a controller configured to control the data driver and the scan driver. The controller includes a single color image determiner configured to determine whether input image data represents a single color image or a mixed color image, and a data compensator configured to generate the output image data by compensating the input image data using the first color, second color, and third color compensation value sets to which the first color, second color, and third color scale factors are not applied when the input image data represents the single color image, and to generate the output image data by compensating the input image data using the first color, second color, and third color compensation value sets to which the first color, second color, and third color scale factors are respectively applied when the input image data represents the mixed color image.

In some example embodiments, the single color image determiner may determine that the input image data represents the single color image when the input image data includes single color pixel data with respect to pixels of which a number is greater than or equal to a reference number from among the plurality of pixels, and may determine that the input image data represents the mixed color image when the input image data includes the single color pixel data with respect to pixels of which a number is less than the reference number from among the plurality of pixels.

In some example embodiments, white, first color, second color, and third color loading luminances may be obtained by capturing white, first color, second color, and third color loading patterns displayed by the display device, respectively, and the first color, second color, and third color scale factors may be calculated by dividing a luminance decrease ratio of the white loading luminance by luminance decrease ratios of the first color, second color, and third color loading luminances, respectively.

In some example embodiments, the first color, second color, and third color scale factors may be applied to the first color, second color, and third color compensation value sets by using an equation, "FINAL_COMP_VAL=1−((1−COMP_VAL)*SCALE_FACTOR)", where COMP_VAL represents a compensation value in a corresponding one of the first color, second color, and third color compensation value sets, SCALE_FACTOR represents a corresponding one of the first color, second color, and third color scale factors, and FINAL_COMP_VAL represents the compensation value to which the corresponding one of the first color, second color, and third color scale factors is applied.

As described above, in a method of generating compensation data for a display device, a method of operating the display device, and the display device according to example embodiments, white, first color (e.g., red), second color (e.g., green), and third color (e.g., blue) loading luminances may be respectively obtained by capturing white, first color, second color, and third color loading patterns, and first color, second color, and third color scale factors may be respectively calculated by dividing a luminance decrease ratio of the white loading luminance by luminance decrease ratios of the first color, second color, and third color loading luminances, respectively. The first color, second color, and third color scale factors may be selectively used in compensating input image data of the display device according to whether the input image data represents a single color image or a mixed color image. Accordingly, a color deviation may not occur not only in the single color image, but also in the mixed color image.

BRIEF DESCRIPTION OF THE DRAWINGS

Illustrative, non-limiting example embodiments will be more clearly understood from the following detailed description in conjunction with the accompanying drawings.

FIG. 5 is a diagram for describing an example of calculating first color, second color, and third color scale factors based on black, white, first color, second color, and third color loading luminances, according to some example embodiments of the present disclosure.

FIG. 7 is a diagram illustrating compensation values to which scale factors are not applied and compensation values to which scale factors are applied, according to some example embodiments of the present disclosure.

DETAILED DESCRIPTION

Figure 1:
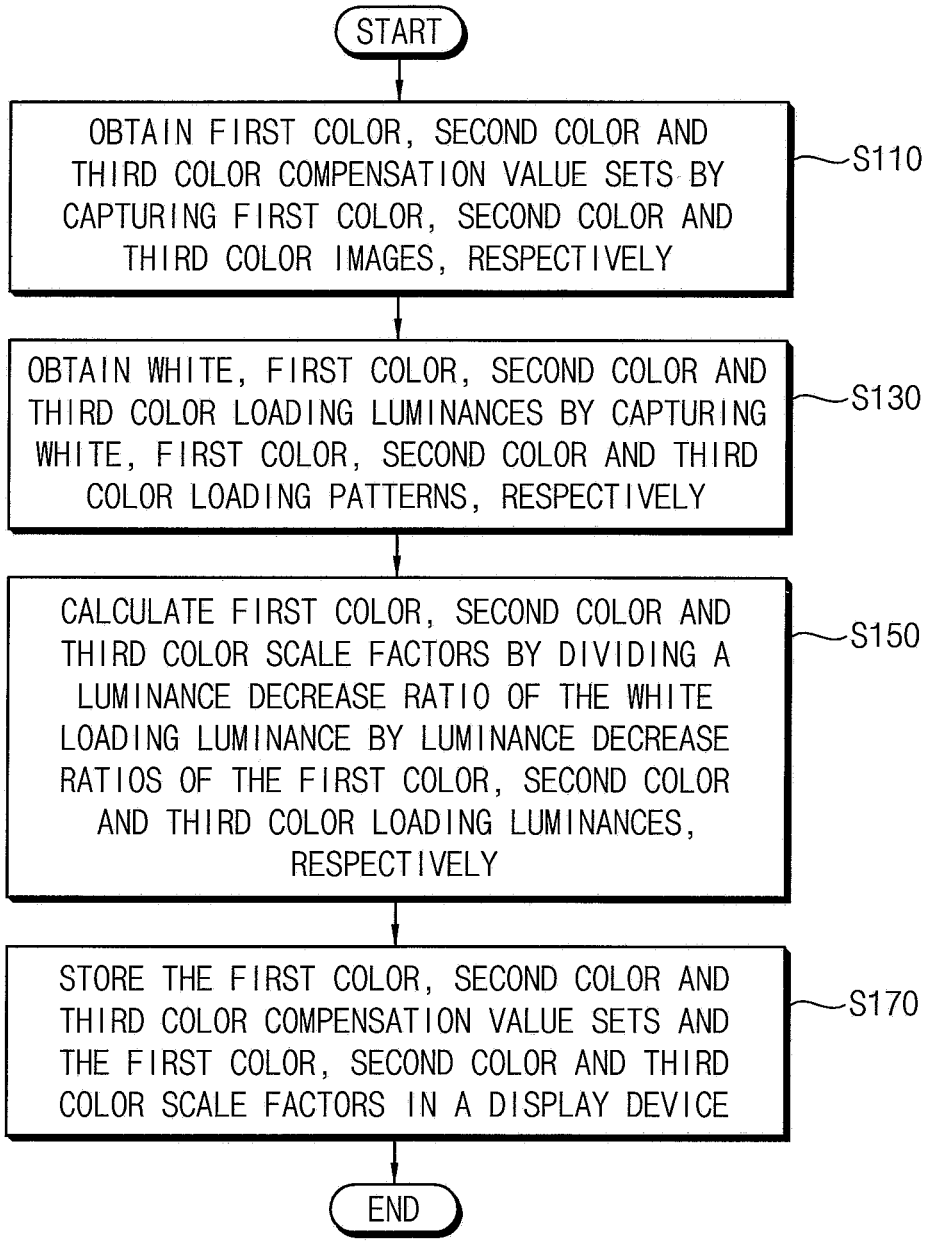
FIG. 1 is a flowchart illustrating a method of generating compensation data for a display device according to some example embodiments of the present disclosure.

Hereinafter, example embodiments of the present disclosure will be explained in detail with reference to the accompanying drawings.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the scope of the present disclosure.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the present disclosure. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the present disclosure refers to "one or more embodiments of the present disclosure". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

In some embodiments, one or more outputs of the different embodiments of the methods and systems of the present disclosure may be transmitted to an electronics device coupled to or having a display device for displaying the one or more outputs or information regarding the one or more outputs of the different embodiments of the methods and systems of the present disclosure.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present disclosure.

Figure 2:
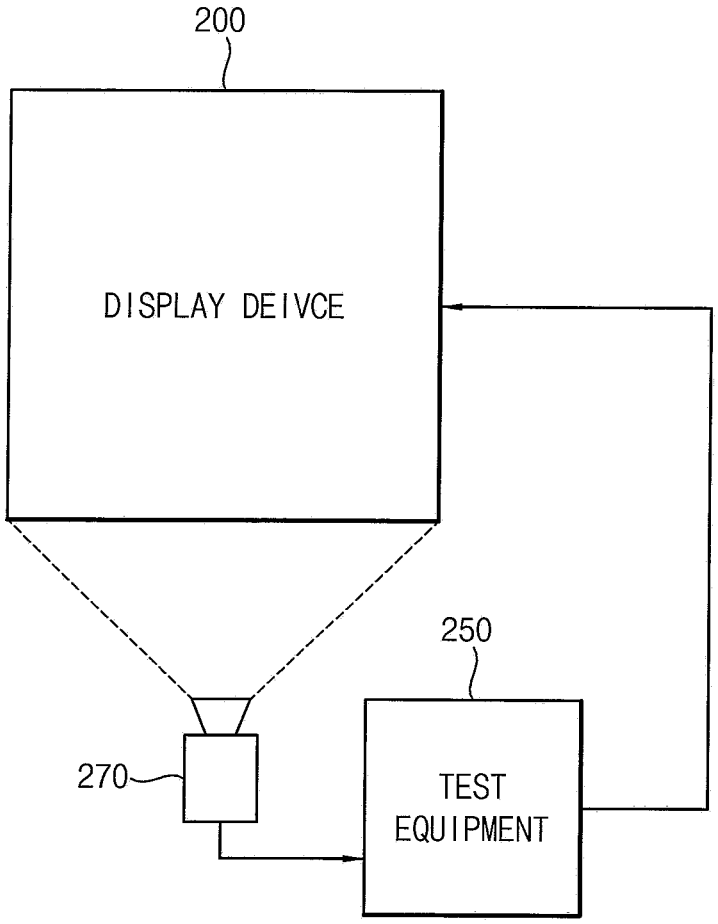
FIG. 2 is a block diagram illustrating an example of a test equipment performing a method of FIG. 1, according to some example embodiments of the present disclosure.
Figure 3:
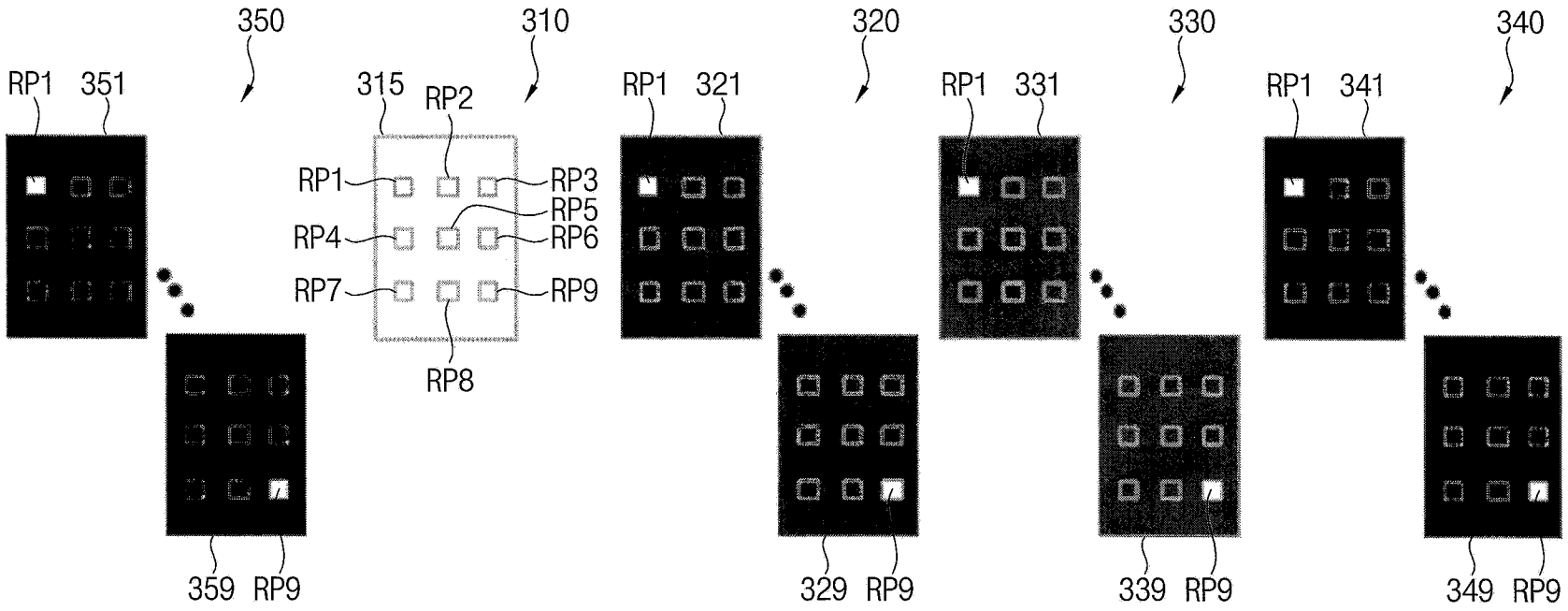
FIG. 3 is a diagram illustrating an example of black, white, first color, second color, and third color loading patterns, according to some example embodiments of the present disclosure.
Figure 4:
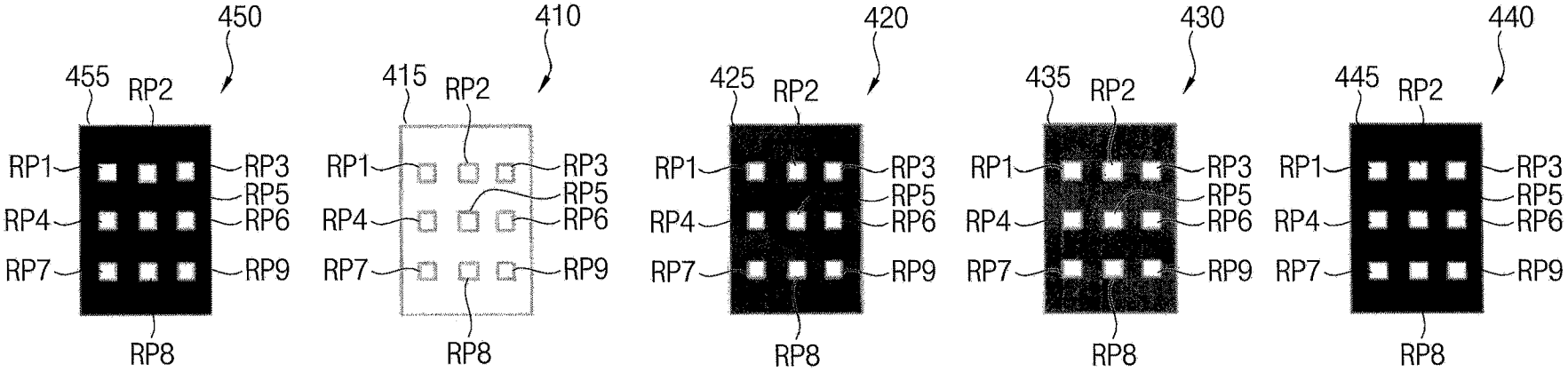
FIG. 4 is a diagram illustrating another example of black, white, first color, second color, and third color loading patterns, according to some example embodiments of the present disclosure.

FIG. 1 is a flowchart illustrating a method of generating compensation data for a display device according to some example embodiments of the present disclosure. FIG. 2 is a block diagram illustrating an example of a test equipment performing a method of FIG. 1, according to some example embodiments of the present disclosure. FIG. 3 is a diagram illustrating an example of black, white, first color, second color, and third color loading patterns, according to some example embodiments of the present disclosure. FIG. 4 is a diagram illustrating another example of black, white, first color, second color, and third color loading patterns, according to some example embodiments of the present disclosure, and FIG. 5 is a diagram for describing an example of calculating first color, second color, and third color scale factors based on black, white, first color, second color, and third color loading luminance, according to some example embodiments of the present disclosure.

Referring to FIGS. 1 and 2, a method of generating compensation data for a display device 200 according to some example embodiments may be performed by a test equipment 250. The test equipment 250 may respectively obtain first color, second color, and third color compensation value sets by capturing first color, second color, and third color images displayed by the display device 200 by a camera (e.g., a charge coupled device (CCD) camera) 270 (S110). For example, a red compensation value set may be obtained by capturing a red image displayed by the display device 200, a green compensation value set may be obtained by capturing a green image displayed by the display device 200, and a blue compensation value set may be obtained by capturing a blue image displayed by the display device 200. In some example embodiments, each of the red, green, and blue compensation value sets may include a plurality of compensation values respectively obtained at a plurality of combinations of a plurality of reference positions and a plurality of reference gray levels (e.g., a 0-gray level, a 1-gray level, a 3-gray level, a 7-gray level, a 12-gray level, a 24-gray level, a 37-gray level, a 54-gray level, a 92-gray level, a 160-gray level, a 215-gray level, and a 255-gray level).

The test equipment 250 may respectively obtain white, first color, second color, and third color loading luminances by capturing white, first color, second color, and third color loading patterns displayed by the display device 200 (S130).

For example, the white loading luminance may be obtained by capturing the white loading pattern displayed by the display device 200, a red loading luminance may be obtained by capturing a red loading pattern displayed by the display device 200, a green loading luminance may be obtained by capturing a green loading pattern displayed by the display device 200, and a blue loading luminance may be obtained by capturing a blue loading pattern displayed by the display device 200. In some example embodiments, the white loading luminance may be obtained by capturing a white image as the white loading pattern, the first color loading luminance at a reference position may be obtained by capturing, as the first color loading pattern, an image having a first color background and a white portion at the reference position, the second color loading luminance at the reference position may be obtained by capturing, as the second color loading pattern, an image having a second color background and the white portion at the reference position, and the third color loading luminance at the reference position may be obtained by capturing, as the third color loading pattern, an image having a third color background and the white portion at the reference position.

In some example embodiments, the first color, second color, and third color loading luminances may be obtained at a plurality of reference positions. Further, in some example embodiments, the first color loading luminance at the plurality of reference positions may be obtained by sequentially capturing a plurality of images having the first color background and further respectively having a plurality of white portions at the plurality of reference positions, the second color loading luminance at the plurality of reference positions may be obtained by sequentially capturing a plurality of images having the second color background and further respectively having the plurality of white portions at the plurality of reference positions, and the third color loading luminance at the plurality of reference positions may be obtained by sequentially capturing a plurality of images having the third color background and further respectively having the plurality of white portions at the plurality of reference positions. For example, in some embodiments, the first color loading luminance at the plurality of reference positions may be obtained by sequentially capturing a plurality of images having the first color background, where the plurality of captured images having the first color background have the plurality of white portions at the plurality of reference positions, respectively, the second color loading luminance at the plurality of reference positions may be obtained by sequentially capturing a plurality of images having the second color background, where the plurality of captured images having the second color background have the plurality of white portions at the plurality of reference positions, respectively, and the third color loading luminance at the plurality of reference positions may be obtained by sequentially capturing a plurality of images having the third color background, where the plurality of captured images having the third color background have the plurality of white portions at the plurality of reference positions, respectively.

For example, as illustrated in FIG. 3, the white loading luminance 310 may be the white image 315, and the white loading luminance at first through ninth reference positions RP1 through RP9 may be obtained by capturing the white image 315. The red loading pattern 320 may include first through ninth red background images 321 through 329 respectively having the white portion at the first through ninth reference positions RP1 through RP9, and the red loading luminance at the first through ninth reference positions RP1 through RP9 may be obtained by sequentially capturing the first through ninth red background images 321 through 329. The green loading pattern 330 may include first through ninth green background images 331 through 339 respectively having the white portion at the first through ninth reference positions RP1 through RP9, and the green loading luminance at the first through ninth reference positions RP1 through RP9 may be obtained by sequentially capturing the first through ninth green background images 331 through 339. The blue loading pattern 340 may include first through ninth blue background images 341 through 349 respectively having the white portion at the first through ninth reference positions RP1 through RP9, and the blue loading luminance at the first through ninth reference positions RP1 through RP9 may be obtained by sequentially capturing the first through ninth blue background images 341 through 349. In some example embodiments, a black loading luminance may be further obtained by capturing a black loading pattern 350. For example, the black loading pattern 350 may include first through ninth black background images 351 through 359 respectively having the white portion at the first through ninth reference positions RP1 through RP9, and the black loading luminance at the first through ninth reference positions RP1 through RP9 may be obtained by sequentially capturing the first through ninth black background images 351 through 359. Each black background image (i.e., each of the black background images) 351 through 359 may be an image having low loading or no loading, and thus the black loading luminance may be used as a reference luminance in calculating luminance decrease ratios of the white, red, green, and blue loading luminances.

In other example embodiments, the first color loading luminance at the plurality of reference positions may be obtained by capturing a single image having the first color background and further having a plurality of white portions at the plurality of reference positions, the second color loading luminance at the plurality of reference positions may be obtained by capturing a single image having the second color background and further having the plurality of white portions at the plurality of reference positions, and the third color loading luminance at the plurality of reference positions may be obtained by capturing a single image having the third color background and further having the plurality of white portions at the plurality of reference positions.

For example, as illustrated in FIG. 4, the white loading luminance 410 may be the white image 415, and the white loading luminance at first through ninth reference positions RP1 through RP9 may be obtained by capturing the white image 415. The red loading pattern 420 may include a single red background image 425 having the plurality of white portions at the first through ninth reference positions RP1 through RP9, and the red loading luminance at the first through ninth reference positions RP1 through RP9 may be obtained by capturing the single red background image 425. The green loading pattern 430 may include a single green background image 435 having the plurality of white portions at the first through ninth reference positions RP1 through RP9, and the green loading luminance at the first through ninth reference positions RP1 through RP9 may be obtained by capturing the single green background image 435. The blue loading pattern 440 may include a single blue background image 445 having the plurality of white portions at the first through ninth reference positions RP1 through RP9, and the blue loading luminance at the first through ninth reference positions RP1 through RP9 may be obtained by capturing the single blue background image 445. In some example embodiments, a black loading luminance may be further obtained by capturing a black loading pattern 450. For example, the black loading pattern 450 may include a single black background image 455 having the plurality of white portions at the first through ninth reference positions RP1 through RP9, and the black loading luminance at the first through ninth reference positions RP1 through RP9 may be obtained by capturing the single black background image 455.

The test equipment 250 may respectively calculate first color, second color, and third color scale factors by dividing a luminance decrease ratio of the white loading luminance by luminance decrease ratios of the first color, second color, and third color loading luminances, respectively (S150). In some example embodiments, the luminance decrease ratio of the white loading luminance may be calculated by dividing a difference between the white loading luminance and the black loading luminance by the black loading luminance, the luminance decrease ratio of the first color loading luminance may be calculated by dividing a difference between the first color loading luminance and the black loading luminance by the black loading luminance, the luminance decrease ratio of the second color loading luminance may be calculated by dividing a difference between the second color loading luminance and the black loading luminance by the black loading luminance, the luminance decrease ratio of the third color loading luminance may be calculated by dividing a difference between the third color loading luminance and the black loading luminance by the black loading luminance, the first color scale factor may be calculated by dividing the luminance decrease ratio of the white loading luminance by the luminance decrease ratio of the first color loading luminance, the second color scale factor may be calculated by dividing the luminance decrease ratio of the white loading luminance by the luminance decrease ratio of the second color loading luminance, and the third color scale factor may be calculated by dividing the luminance decrease ratio of the white loading luminance by the luminance decrease ratio of the third color loading luminance. Further, in some example embodiments, the first color, second color, and third color scale factors are obtained at a plurality of reference positions based on the white, first color, second color, and third color loading luminances at the plurality of reference positions.

For example, as illustrated in FIG. 3 or FIG. 4, the black, white, red, green, and blue loading luminances may be obtained at the first through ninth reference positions RP1 through RP9. An example of the black, white, red, green, and blue loading luminances at the first through ninth reference positions RP1 through RP9 is illustrated in a first table 510 of FIG. 5. Further, an example of luminance decrease ratios of the white, red, green, and blue loading luminances to the black loading luminance at the first through ninth reference positions RP1 through RP9 is illustrated in a second table 530 of FIG. 5. The luminance decrease ratio of the white, red, green, or blue loading luminance at each reference position (e.g., each of the first through ninth reference positions RP1 through RP9) may be calculated by dividing a difference between the white, red, green, or blue loading luminance and the black loading luminance by the black loading luminance. For example, the luminance decrease ratio of the white loading luminance at the first reference position RP1 may be calculated as about 3.3% by dividing a difference of 10 between the white loading luminance of 290 at the first reference position RP1 and the black loading luminance of 300 at the first reference position RP1 by the black loading luminance of 300 at the first reference position RP1, the luminance decrease ratio of the red loading luminance at the first reference position RP1 may be calculated as about 0.7% by dividing a difference of 2 between the red loading luminance of 298 at the first reference position RP1 and the black loading luminance of 300 at the first reference position RP1 by the black loading luminance of 300 at the first reference position RP1, the luminance decrease ratio of the green loading luminance at the first reference position RP1 may be calculated as about 0.3% by dividing a difference of 1 between the green loading luminance of 299 at the first reference position RP1 and the black loading luminance of 300 at the first reference position RP1 by the black loading luminance of 300 at the first reference position RP1, and the luminance decrease ratio of the blue loading luminance at the first reference position RP1 may be calculated as about 2.3% by dividing a difference of 7 between the blue loading luminance of 293 at the first reference position RP1 and the black loading luminance of 300 at the first reference position RP1 by the black loading luminance of 300 at the first reference position RP1. Further, a third table 550 of FIG. 5 illustrates an example of red, green, and blue scale factors at the first through ninth reference positions RP1 through RP9, and further illustrates an example of a white scale factor at the first through ninth reference positions RP1 through RP9, for reference. The red, green, or blue scale factor at each reference position (e.g., each of the first through ninth reference positions RP1 through RP9) may be calculated by dividing the luminance decrease ratio of the white loading luminance by the luminance decrease ratio of the red, green, or blue loading luminance. For example, the red scale factor at the first reference position RP1 may be calculated as about 5 by dividing the white loading luminance decrease ratio of about 3.3% at the first reference position RP1 by the red loading luminance decrease ratio of about 0.7% at the first reference position RP1, the green scale factor at the first reference position RP1 may be calculated as about 10 by dividing the white loading luminance decrease ratio of about 3.3% at the first reference position RP1 by the green loading luminance decrease ratio of about 0.3% at the first reference position RP1, and the blue scale factor at the first reference position RP1 may be calculated as about 1.4 by dividing the white loading luminance decrease ratio of about 3.3% at the first reference position RP1 by the blue loading luminance decrease ratio of about 2.3% at the first reference position RP1. Although FIG. 5 illustrates an example where each of the red, green, and blue scale factors has substantially the same value at the first through ninth reference positions RP1 through RP9, in some example embodiments, each of the red, green, and blue scale factors may have different values at the first through ninth reference positions RP1 through RP9.

According to some example embodiments, the first color, second color, and third color scale factors may be obtained at a particular gray level (e.g., the maximum gray level), at the entire gray levels, or at a plurality of reference gray levels.

In some example embodiments, the white, first color, second color, and third color loading luminances may be obtained at the maximum gray level (e.g., a 255-gray level), and the first color, second color, and third color scale factors may be obtained at the maximum gray level based on the white, first color, second color, and third color loading luminances at the maximum gray level. In the example embodiment of FIG. 3, the white, red, green, and blue loading luminances at the 255-gray level may be obtained by using the white image 315 of the red 255-gray level, the green 255-gray level, and the blue 255-gray level, the red background images 321 through 329 of the red 255-gray level, the green 0-gray level, and the blue 0-gray level having the white portion of the red 255-gray level, the green 255-gray level, and the blue 255-gray level, the green background images 331 through 339 of the red 0-gray level, the green 255-gray level, and the blue 0-gray level having the white portion of the red 255-gray level, the green 255-gray level, and the blue 255-gray level, the blue background images 341 through 349 of the red 0-gray level, the green 0-gray level, and the blue 255-gray level having the white portion of the red 255-gray level, the green 255-gray level, and the blue 255-gray level, and the black background images 351 through 359 of the red 0-gray level, the green 0-gray level, and the blue 0-gray level having the white portion of the red 255-gray level, the green 255-gray level, and the blue 255-gray level. Further, the red, green, and blue scale factors may be obtained at the maximum gray level (e.g., the 255-gray level) based on the white, red, green, and blue loading luminances at the maximum gray level (e.g., the 255-gray level).

In some other example embodiments, the white, first color, second color, and third color loading luminances may be obtained at the entire gray levels (e.g., from a 1-gray level to the 255-gray level) used in the display device 200, and the first color, second color, and third color scale factors at the entire gray levels may be obtained based on the white, first color, second color, and third color loading luminances at the entire gray levels. In an example of FIG. 3, with respect to a 10-gray level among the entire gray levels, the white, red, green, and blue loading luminances at the 10-gray level may be obtained by using the white image 315 of the red 10-gray level, the green 10-gray level, and the blue 10-gray level, the red background images 321 through 329 of the red 10-gray level, the green 0-gray level, and the blue 0-gray level having the white portion of the red 10-gray level, the green 10-gray level, and the blue 10-gray level, the green background images 331 through 339 of the red 0-gray level, the green 10-gray level, and the blue 0-gray level having the white portion of the red 10-gray level, the green 10-gray level, and the blue 10-gray level, the blue background images 341 through 349 of the red 0-gray level, the green 0-gray level, and the blue 10-gray level having the white portion of the red 10-gray level, the green 10-gray level, and the blue 10-gray level, and the black background images 351 through 359 of the red 0-gray level, the green 0-gray level, and the blue 0-gray level having the white portion of the red 10-gray level, the green 10-gray level, and the blue 10-gray level. This operation may be performed multiple number of times (e.g., 255 times) corresponding to the number of the entire gray levels to obtain the white, red, green, and blue loading luminances at the entire gray levels. Further, the red, green, and blue scale factors may be obtained at the entire gray levels based on the white, red, green, and blue loading luminances at the entire gray levels.

In still other example embodiments, the white, first color, second color, and third color loading luminances may be obtained at the plurality of reference gray levels (e.g., the 0-gray level, the 1-gray level, the 3-gray level, the 7-gray level, the 12-gray level, the 24-gray level, the 37-gray level, the 54-gray level, the 92-gray level, the 160-gray level, the 215-gray level, and the 255-gray level) that is a portion of the entire gray levels used in the display device 200, and the first color, second color, and third color scale factors may be obtained at the plurality of reference gray levels based on the white, first color, second color, and third color loading luminances at the plurality of reference gray levels.

The test equipment 250 may store the first color, second color, and third color compensation value sets and the first color, second color, and third color scale factors in the display device 200 (S170). The display device 200 may compensate input image data of the display device 200 by using the first color, second color, and third color compensation value sets, and may selectively use the first color, second color, and third color scale factors in compensating the input image data according to whether the input image data represents a single color image or a mixed color image. In some example embodiments, when the input image data represents the single color image, the display device 200 may compensate the input image data by using the first color, second color, and third color compensation value sets to which the first color, second color, and third color scale factors are not applied. Further, when the input image data represents the mixed color image, the display device 200 may compensate the input image data by using the first color, second color, and third color compensation value sets to which the first color, second color, and third color scale factors are respectively applied. For example, the display device 200 may apply the first color, second color, and third color scale factors to the first color, second color, and third color compensation value sets by using an equation, "FINAL_COMP_VAL=1−((1−COMP_VAL)* SCALE_FACTOR)". Here, COMP_VAL may represent a compensation value included in a corresponding one of the first color, second color, and third color compensation value sets, SCALE_FACTOR may represent a corresponding one of the first color, second color, and third color scale factors, and FINAL_COMP_VAL may represent the compensation value to which the corresponding one of the first color, second color, and third color scale factors is applied. If the first color, second color, and third color scale factors are respectively applied to the first color, second color, and third color compensation value sets, compensation values for a first color (e.g., red), a second color (e.g., green), and a third color (e.g., blue) of each pixel may be substantially the same, and thus a color deviation between red luminance, green luminance, and blue luminance of each pixel may not occur.

As described above, in the method of generating compensation data for the display device 200 according to some example embodiments, the white, first color (e.g., red), second color (e.g., green), and third color (e.g., blue) loading luminances may be respectively obtained by capturing the white, first color, second color, and third color loading patterns, and the first color, second color, and third color scale factors may be respectively calculated by dividing the luminance decrease ratio of the white loading luminance by the luminance decrease ratios of the first color, second color, and third color loading luminances. The first color, second color, and/or third color scale factors may be selectively used in compensating the input image data of the display device 200 according to whether the input image data represents the single color image or the mixed color image. Accordingly, the color deviation may not occur not only in the single color image, but also in the mixed color image.

Figure 6:
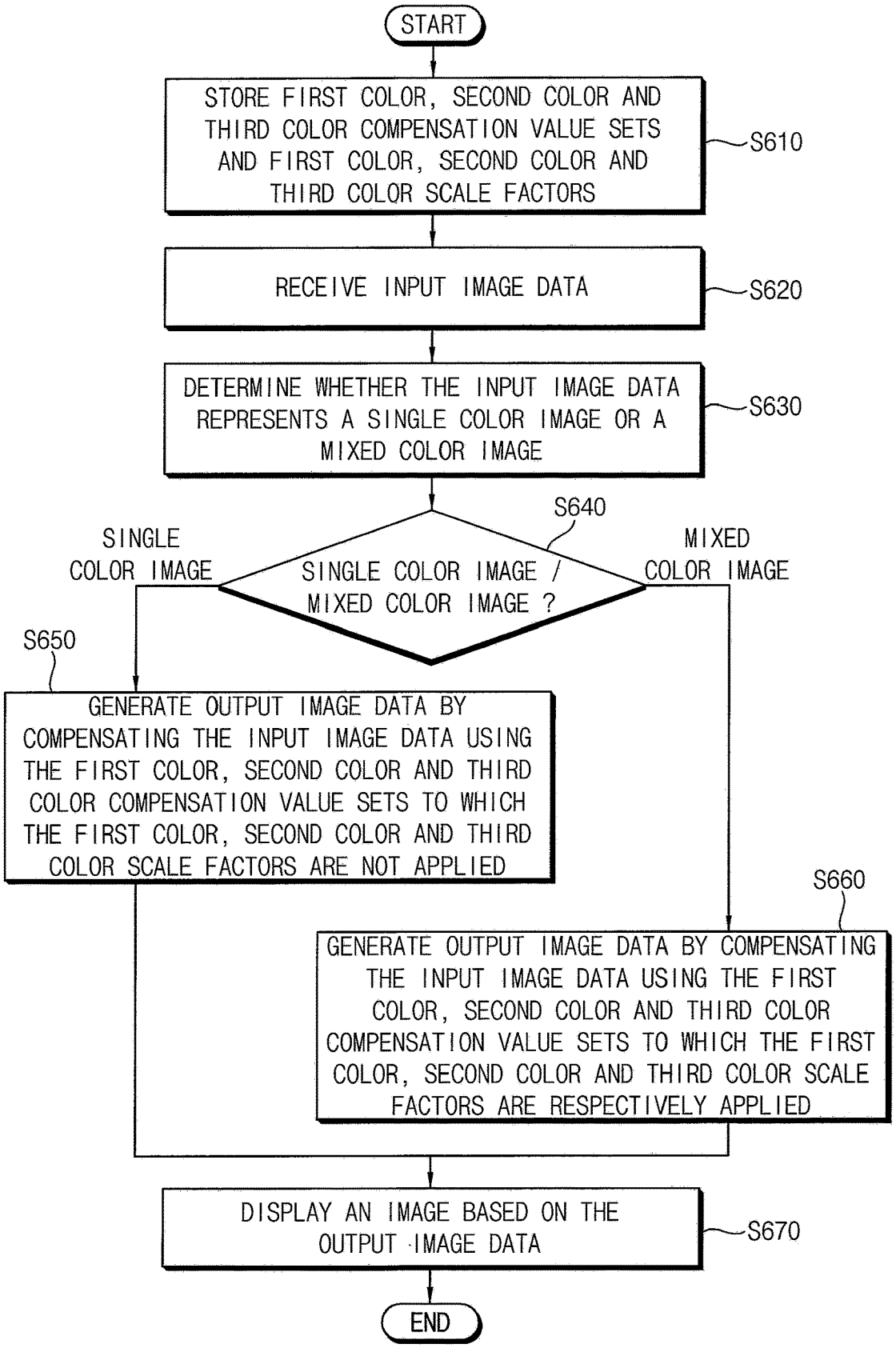
FIG. 6 is a flowchart illustrating a method of operating a display device according to some example embodiments of the present disclosure.
Figure 8:
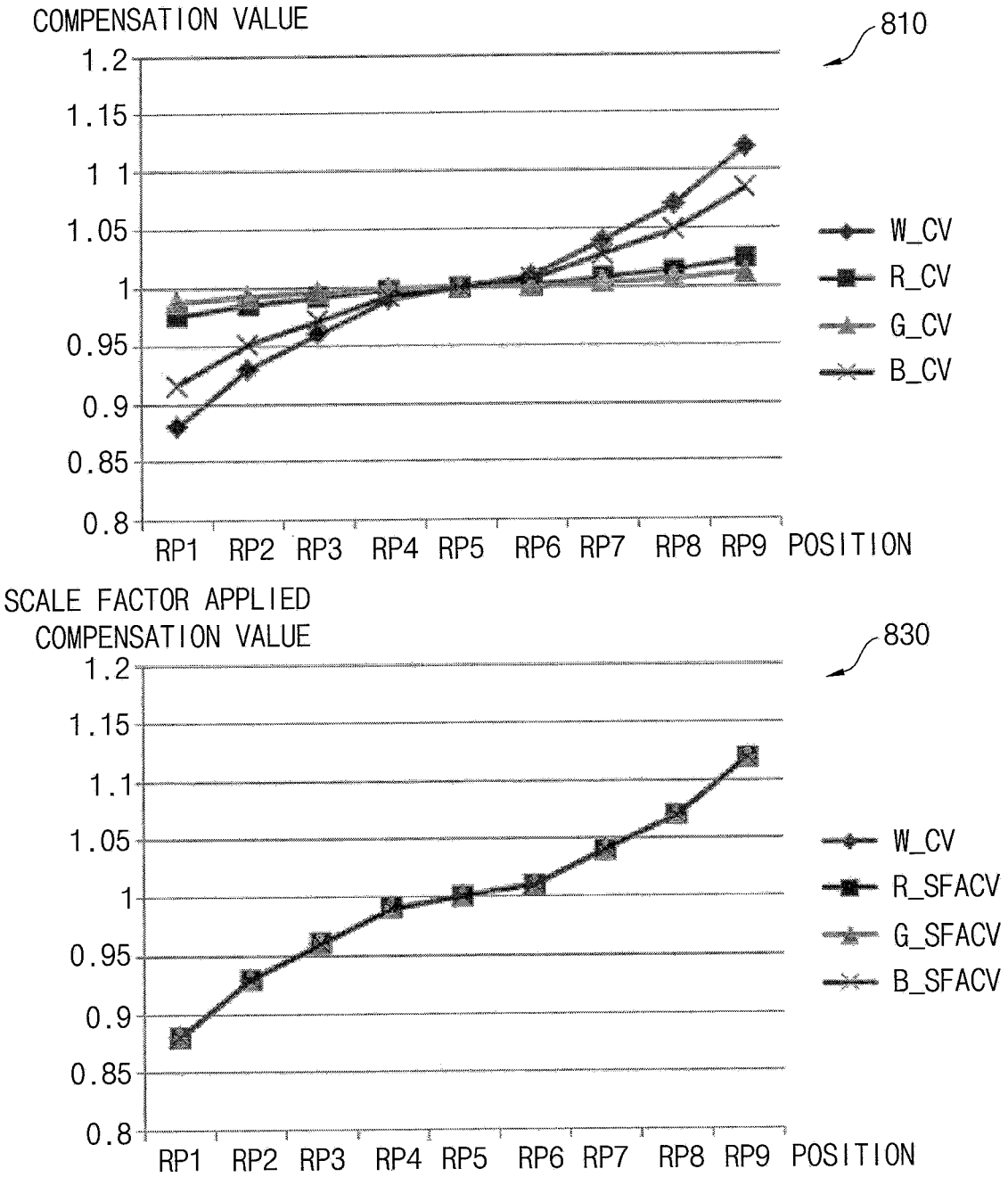
FIG. 8 is a graph illustrating compensation values to which scale factors are not applied and compensation values to which scale factors are applied, according to some example embodiments of the present disclosure.

FIG. 6 is a flowchart illustrating a method of operating a display device according to some example embodiments of the present disclosure, FIG. 7 is a diagram illustrating compensation values to which scale factors are not applied and compensation values to which scale factors are applied, according to some example embodiments of the present disclosure, and FIG. 8 is a graph illustrating compensation values to which scale factors are not applied and compensation values to which scale factors are applied, according to some example embodiments of the present disclosure.

Referring to FIG. 6, a display device according to some example embodiments, may store first color, second color, and third color compensation value sets and first color, second color, and third color scale factors (S610). For example, the display device may store red, green, and blue compensation value sets and red, green, and blue scale factors. In some example embodiments, white, first color, second color, and third color loading luminances may be obtained by capturing white, first color, second color, and third color loading patterns displayed by the display device, respectively, and the first color, second color, and third color scale factors may be calculated by dividing a luminance decrease ratio of the white loading luminance by luminance decrease ratios of the first color, second color, and third color loading luminances, respectively. Further, in some example embodiments, each of the red, green, and blue compensation value sets may include a plurality of compensation values respectively obtained at a plurality of combinations of a plurality of first reference positions and a plurality of first reference gray levels. Further, in some example embodiments, the first color, second color and third color scale factors may be stored at a plurality of second reference positions. Further, according to example embodiments, the first color, second color, and third color scale factors may be stored at the maximum gray level, at the entire gray levels, or at a plurality of second reference gray levels.

The display device may receive input image data (S620), and may determine whether the input image data represents a single color image or a mixed color image (S630). In some example embodiments, the display device may determine that the input image data represents the single color image when the input image data includes single color pixel data (e.g., where two of red sub-pixel data, green sub-pixel data, and blue sub-pixel data represent a 0-gray level) with respect to pixels of which the number is greater than or equal to a reference number (e.g., over about 90% of the entire pixels). Further, the display device may determine that the input image data represents the mixed color image when the input image data includes the single color pixel data with respect to pixels of which the number is less than the reference number (e.g., below about 90% of the entire pixels).

When the input image data represents the single color image (S640: SINGLE COLOR IMAGE), the display device may generate output image data by compensating the input image data using the first color, second color, and third color compensation value sets to which the first color, second color, and third color scale factors are not applied (S650). Further, the display device may display an image based on the output image data (S670).

However, when the input image data represents the mixed color image (S640: MIXED COLOR IMAGE), the display device may generate the output image data by compensating the input image data using the first color, second color, and third color compensation value sets to which the first color, second color, and third color scale factors are respectively applied (S660). In some example embodiments, the first color, second color, and third color scale factors may be applied to the first color, second color, and third color compensation value sets by using an equation, "FINAL_COMP_VAL=1−((1−COMP_VAL)* SCALE_FACTOR)". Here, COMP_VAL may represent a compensation value included in a corresponding one of the first color, second color, and third color compensation value sets, SCALE_FACTOR may represent a corresponding one of the first color, second color, and third color scale factors, and FINAL_COMP_VAL may represent the compensation value to which the corresponding one of the first color, second color, and third color scale factors is applied. Further, the display device may display an image based on the output image data (S670).

For example, FIG. 7 illustrates a first table 710 including red, green, and blue compensation values at first through ninth reference positions RP1 through RP9 to which red, green, and blue scale factors are not applied, and including white compensation values calculated by multiplying the red, green, and blue compensation values at the first through ninth reference positions RP1 through RP9 for reference, and a second table 730 including the red, green, and blue compensation values at the first through ninth reference positions RP1 through RP9 to which the red, green, and blue scale factors are applied, and including the white compensation values at the first through ninth reference positions RP1 through RP9 for reference.

FIG. 8 illustrates a first graph 810 representing the red compensation values R_CV at the first through ninth reference positions RP1 through RP9 of the first table 710 to which the red scale factor is not applied, the green compensation values G_CV at the first through ninth reference positions RP1 through RP9 of the first table 710 to which the green scale factor is not applied, the blue compensation values B_CV at the first through ninth reference positions RP1 through RP9 of the first table 710 to which the blue scale factor is not applied, and the white compensation values W_CV at the first through ninth reference positions RP1 through RP9 of the first table 710, and a second graph 830 representing the red compensation values R_SFACV at the first through ninth reference positions RP1 through RP9 of the second table 730 to which the red scale factor is applied, the green compensation values G_SFACV at the first through ninth reference positions RP1 through RP9 of the second table 730 to which the green scale factor is applied, the blue compensation values B_SFACV at the first through ninth reference positions RP1 through RP9 of the second table 730 to which the blue scale factor is applied, and the white compensation values W_CV at the first through ninth reference positions RP1 through RP9 of the second table 730. Here, in the second graph 830, the plot for red compensation values R_SFACV, the plot for green compensation values G_SFACV, the plot for blue compensation values B_SFACV, and the plot for white compensation values W_CV of the second table 730 are shown to substantially overlap each other.

FIGS. 7 and 8 illustrate an example where the red, green and blue scale factors are about 5, about 10, and about 1.4. Each color scale factor may be applied to a corresponding color compensation value by using an equation, "FINAL_COMP_VAL=1−((1−COMP_VAL)* SCALE_FACTOR)". For example, in the first reference position RP1, the red scale factor of about 5 may be applied to the red compensation value of about 0.976 to obtain the red scale factor-applied red compensation value of "1−((1−0.976)*5)=0.88", the green scale factor of about 10 may be applied to the green compensation value of about 0.988 to obtain the green scale factor-applied green compensation value of "1−((1−0.988)*10)=0.88", and the blue scale factor of about 1.4 may be applied to the blue compensation value of about 0.916 to obtain the blue scale factor-applied blue compensation value of "1−((1−0.916)*1.4)=0.88". In the mixed color image including two or more of the red color, the green color and the blue color, in particular, in a high-gray mixed color image, a color deviation between the red color, the green color, and the blue color may be caused by a loading effect. However, as illustrated as the second table 730 of FIG. 7 and as the second graph 830 of FIG. 8, when the mixed color image is displayed, the input image data may be compensated by using the red, green, and blue compensation values to which the red, green, and blue scale factors are applied by considering the loading effect, and thus the color deviation may not occur even in the mixed color image.

Figure 9:
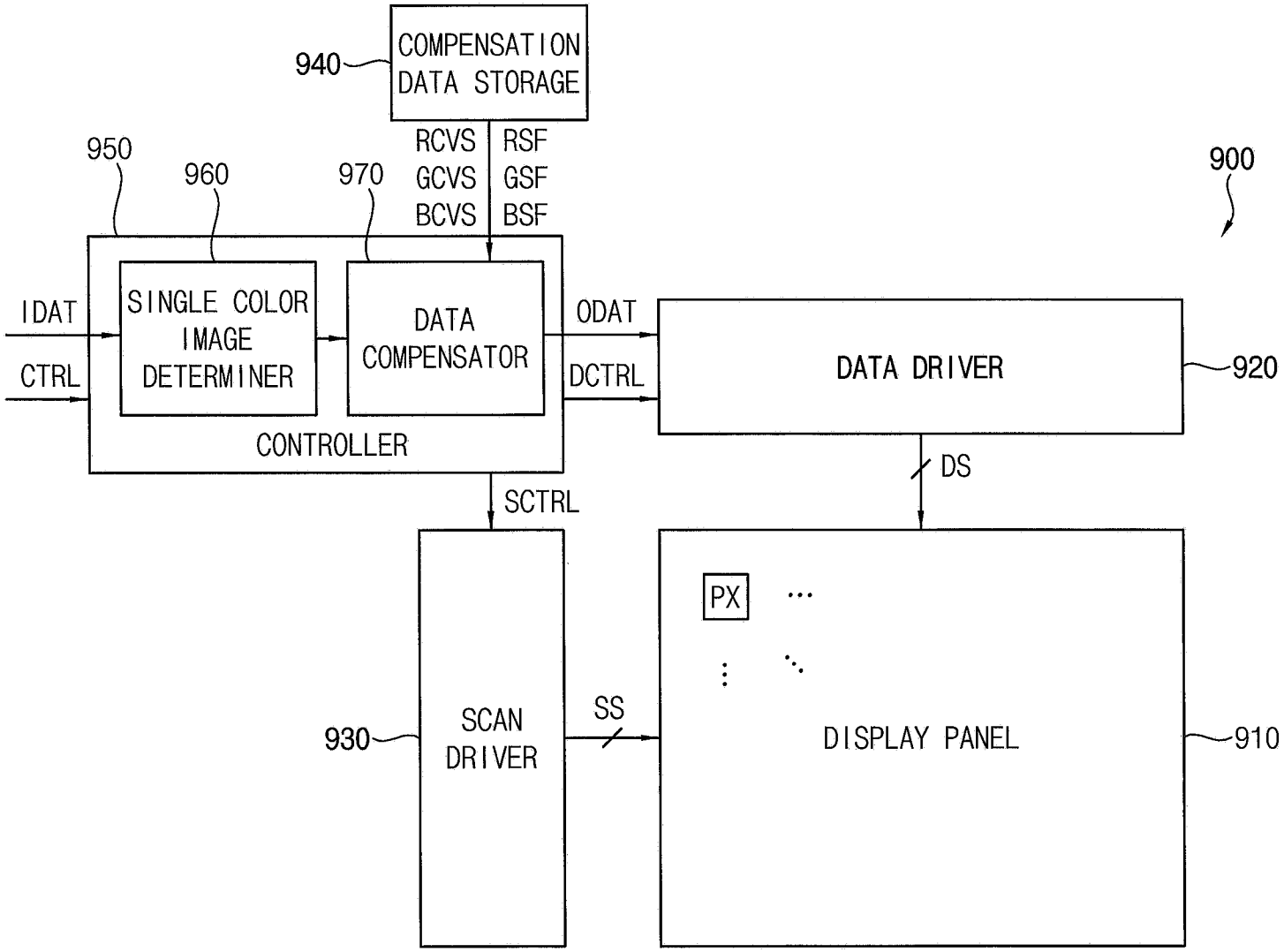
FIG. 9 is a block diagram illustrating a display device according to some example embodiments of the present disclosure.

FIG. 9 is a block diagram illustrating a display device according to some example embodiments of the present disclosure.

Referring to FIG. 9, a display device 900 according to some example embodiments may include a display panel 910 that includes a plurality of pixels PX, a data driver 920 that provides data signals DS to the plurality of pixels PX, a scan driver 930 that provides scan signals SS to the plurality of pixels PX, a compensation data storage 940, and a controller 950 that controls the data driver 920 and the scan driver 930.

The display panel 910 may include a plurality of data lines, a plurality of scan lines, and the plurality of pixels PX coupled to the plurality of data lines and the plurality of scan lines. In some example embodiments, each pixel PX may include at least one capacitor, at least two transistors and an organic light emitting diode (OLED), and the display panel 910 may be an OLED display panel. In other example embodiments, the display panel 910 may be a liquid crystal display (LCD) panel, or any suitable display panel.

The data driver 920 may generate the data signals DS based on output image data ODAT and a data control signal DCTRL received from the controller 950, and may provide the data signals DS corresponding to the output image data ODAT to the plurality of pixels PX through the plurality of data lines. In some example embodiments, the data control signal DCTRL may include, but not limited to, an output data enable signal, a horizontal start signal, and a load signal. In some example embodiments, the data driver 920 and the controller 950 may be implemented with a single integrated circuit, and the single integrated circuit may be referred to as timing controller embedded data driver (TED). In other example embodiments, the data driver 920 and the controller 950 may be implemented with separate integrated circuits.

The scan driver 930 may generate the scan signals SS based on a scan control signal SCTRL from the controller 950, and may sequentially provide the scan signals SS to the plurality of pixels PX through the plurality of scan lines on a row-by-row basis. In some example embodiments, the scan control signal SCTRL may include, but not limited to, a scan start signal and a scan clock signal. In some example embodiments, the scan driver 930 may be integrated or formed in a peripheral portion of the display panel 910. In other example embodiments, the scan driver 930 may be implemented with one or more integrated circuits.

The compensation data storage 940 may store first color, second color, and third color compensation value sets RCVS, GCVS, and BCVS, and first color, second color, and third color scale factors RSF, GSF, and BSF. In some example embodiments, the compensation data storage 940 may be implemented with, but not limited to, a nonvolatile memory, such as a flash memory, an electrically erasable programmable read-only memory (EEPROM), etc. In some example embodiments, white, first color, second color, and third color loading luminances may be obtained by capturing white, first color, second color, and third color loading patterns displayed by the display device 900, respectively, and the first color, second color, and third color scale factors may be calculated by dividing a luminance decrease ratio of the white loading luminance by luminance decrease ratios of the first color, second color, and third color loading luminances, respectively, such that the calculated first color, second color, and third color scale factors may be stored in the compensation data storage 940.

The controller (e.g., a timing controller (TCON)) 950 may receive input image data IDAT and a control signal CTRL from an external host processor (e.g., a graphic processing unit (GPU) or a graphic card). In some example embodiments, the control signal CTRL may include, but not limited to, a vertical synchronization signal, a horizontal synchronization signal, an input data enable signal, a master clock signal, etc. The controller 950 may generate the output image data ODAT, the data control signal DCTRL, and the scan control signal SCTRL based on the input image data IDAT and the control signal CTRL. Further, the controller 950 may control an operation of the data driver 920 by providing the output image data ODAT and the data control signal DCTRL to the data driver 920, and may control an operation of the scan driver 930 by providing the scan control signal SCTRL to the scan driver 930.

The controller 950 of the display device 900 according to some example embodiments may include a single color image determiner 960 and a data compensator 970.

The single color image determiner 960 may determine whether the input image data IDAT represents a single color image or a mixed color image. In some example embodiments, the single color image determiner 960 may determine that the input image data IDAT represents a single color image when the input image data IDAT includes single color pixel data (e.g., where two of red sub-pixel data, green sub-pixel data, and blue sub-pixel data represent a 0-gray level) with respect to pixels PX of which the number is greater than or equal to a reference number (e.g., over about 90% of the entire pixels PX). Further, the single color image determiner 960 may determine that the input image data IDAT represents the mixed color image when the input image data IDAT includes the single color pixel data with respect to pixels PX of which the number is less than the reference number (e.g., below about 90% of the entire pixels PX).

The data compensator 970 may generate the output image data ODAT by compensating the input image data IDAT using the first color, second color, and third color compensation value sets RCVS, GCVS, and BCVS to which the first color, second color, and third color scale factors RSF, GSF, and BSF are not applied when the input image data IDAT represents the single color image, and may generate the output image data ODAT by compensating the input image data IDAT using the first color, second color, and third color compensation value sets RCVS, GCVS, and BCVS to which the first color, second color and third color scale factors RSF, GSF, and BSF are respectively applied when the input image data IDAT represents the mixed color image. In some example embodiments, the first color, second color, and third color scale factors RSF, GSF, and BSF may be applied to the first color, second color, and third color compensation value sets RCVS, GCVS, and BCVS by using an equation, "FINAL_COMP_VAL=1−((1−COMP_VAL)* SCALE_FACTOR)". Here, COMP_VAL may represent a compensation value included in a corresponding one of the first color, second color, and third color compensation value sets RCVS, GCVS, and BCVS, SCALE_FACTOR may represent a corresponding one of the first color, second color, and third color scale factors RSF, GSF, and BSF, and FINAL_COMP_VAL may represent the compensation value to which the corresponding one of the first color, second color, and third color scale factors RSF, GSF, and BSF is applied.

In some example embodiments, the first color, second color, and third color compensation value sets RCVS, GCVS, and BCVS may include first color, second color, and third color compensation values at a plurality of first reference positions, and the first color, second color, and third color scale factors RSF, GSF, and BSF may be obtained at a plurality of second reference positions. In this case, with respect to each pixel PX, the first color, second color, and third color compensation values for the pixel PX may be obtained by performing a bilinear interpolation on the first color, second color, and third color compensation values at adjacent four of the plurality of first reference positions, the first color, second color, and third color scale factors RSF, GSF, and BSF for the pixel PX may be obtained by performing a bilinear interpolation on the first color, second color, and third color scale factors RSF, GSF, and BSF at adjacent four of the plurality of second reference positions, and the input image data IDAT for the pixel PX may be compensated by using the first color, second color, and third color compensation values for the pixel PX and/or the first color, second color, and third color scale factors RSF, GSF, and BSF for the pixel PX.

Further, in some example embodiments, the first color, second color, and third color compensation value sets RCVS, GCVS, and BCVS may include the first color, second color, and third color compensation values at a plurality of reference gray levels. In this case, with respect to each pixel PX, the first color, second color, and third color compensation values for the pixel PX may be obtained by performing a linear interpolation on the first color, second color, and third color compensation values at adjacent two of the plurality of reference gray levels. In some example embodiments, the first color, second color, and third color scale factors RSF, GSF, and BSF may be obtained at the maximum gray level. In this case, the input image data IDAT for the pixel PX may be compensated by using the first color, second color, and third color compensation values for the pixel PX and/or the first color, second color, and third color scale factors RSF, GSF, and BSF for the entire gray levels. In other example embodiments, the first color, second color, and third color scale factors RSF, GSF, and BSF may be obtained at the entire gray levels. In this case, the input image data IDAT for the pixel PX may be compensated by using the first color, second color, and third color compensation values for the pixel PX and/or the first color, second color, and third color scale factors RSF, GSF, and BSF for a gray level for the pixel PX. In still other example embodiments, the first color, second color, and third color scale factors RSF, GSF, and BSF may be obtained at a plurality of reference gray levels. In this case, with respect to each pixel PX, the first color, second color, and third color scale factors RSF, GSF, and BSF for the pixel PX may be obtained by performing a linear interpolation on the first color, second color, and third color scale factors RSF, GSF, and BSF at adjacent two of the plurality of reference gray levels. Further, in this case, the input image data IDAT for the pixel PX may be compensated by using the first color, second color, and third color compensation values for the pixel PX and/or the first color, second color, and third color scale factors RSF, GSF, and BSF for the pixel PX.

As described above, the display device 900 according to some example embodiments may store not only the first color, second color, and third color compensation value sets RCVS, GCVS, and BCVS, but also the first color, second color, and third color scale factors RSF, GSF, and BSF, and may selectively use the first color, second color, and third color scale factors RSF, GSF, and BSF in compensating the input image data IDAT according to whether the input image data IDAT represents the single color image or the mixed color image. Accordingly, a color deviation may not occur not only in the single color image, but also in the mixed color image.

Figure 10:
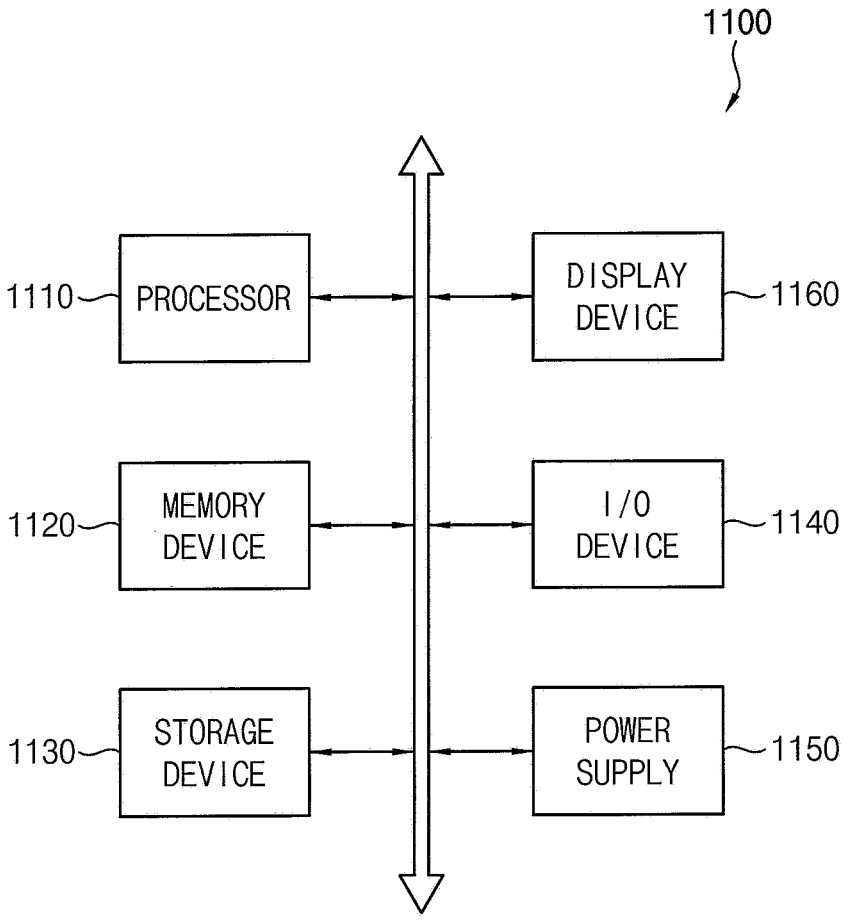
FIG. 10 is a block diagram illustrating an electronic device including a display device according to some example embodiments of the present disclosure.

FIG. 10 is a block diagram illustrating an electronic device including a display device according to some example embodiments of the present disclosure.

Referring to FIG. 10, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

The display device 1160 may store not only first color, second color, and third color compensation value sets, but also first color, second color, and third color scale factors, and may selectively use the first color, second color, and third color scale factors in compensating input image data according to whether the input image data represents a single color image or a mixed color image. Accordingly, a color deviation may not occur not only in the single color image, but also in the mixed color image.

The example embodiments of the present disclosure may be applied to any display device 1160 performing the mura correction, and any electronic device 1100 including the display device 1160. For example, the example embodiments of the present disclosure may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

The foregoing is illustrative of example embodiments and is not to be construed as limiting thereof. Although a few example embodiments have been described, those skilled in the art will readily appreciate that many modifications are possible in the example embodiments without materially departing from the features of the example embodiments of the present disclosure. Accordingly, all such modifications are intended to be included within the scope of the present disclosure as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

What is claimed is:

1. A method of generating compensation data for a display device, the method comprising:

obtaining first color, second color, and third color compensation value sets by capturing first color, second color, and third color images displayed by the display device, respectively;

obtaining white, first color, second color, and third color loading luminances by capturing white, first color, second color, and third color loading patterns displayed by the display device, respectively;

calculating first color, second color, and third color scale factors by dividing a luminance decrease ratio of the white loading luminance by luminance decrease ratios of the first color, second color, and third color loading luminances, respectively, the luminance decrease ratio of the white loading luminance being based on a difference between the white loading luminance and a black loading luminance; and storing the first color, second color, and third color compensation value sets and the first color, second color, and third color scale factors in the display device, wherein the first color, second color, and third color scale factors are selectively utilized in compensating input image data of the display device according to whether the input image data represents a single color image or a mixed color image.

2. The method of claim 1, wherein the obtaining of the white, first color, second color, and third color loading luminances comprise:

obtaining the white loading luminance by capturing a white image as the white loading pattern;

obtaining the first color loading luminance at a reference position by capturing, as the first color loading pattern, an image having a first color background and a white portion at the reference position;

obtaining the second color loading luminance at the reference position by capturing, as the second color loading pattern, an image having a second color background and the white portion at the reference position; and obtaining the third color loading luminance at the reference position by capturing, as the third color loading pattern, an image having a third color background and the white portion at the reference position.

3. The method of claim 2, wherein the first color, second color, and third color loading luminances are obtained at a plurality of reference positions comprising the reference position.

4. The method of claim 3, wherein the first color loading luminance at the plurality of reference positions is obtained by sequentially capturing a plurality of images having the first color background and respectively having a plurality of white portions at the plurality of reference positions, wherein the second color loading luminance at the plurality of reference positions is obtained by sequentially capturing a plurality of images having the second color background and respectively having the plurality of white portions at the plurality of reference positions, and wherein the third color loading luminance at the plurality of reference positions is obtained by sequentially capturing a plurality of images having the third color background and respectively having the plurality of white portions at the plurality of reference positions.

5. The method of claim 3, wherein the first color loading luminance at the plurality of reference positions is obtained by capturing a single image having the first color background and a plurality of white portions at the plurality of reference positions, wherein the second color loading luminance at the plurality of reference positions is obtained by capturing a single image having the second color background and the plurality of white portions at the plurality of reference positions, and wherein the third color loading luminance at the plurality of reference positions is obtained by capturing a single image having the third color background and the plurality of white portions at the plurality of reference positions.

6. The method of claim 1, further comprising:

obtaining the black loading luminance by capturing a black loading pattern, wherein calculating the first color, second color, and third color scale factors comprises:

calculating the luminance decrease ratio of the white loading luminance by dividing the difference between the white loading luminance and the black loading luminance by the black loading luminance;

calculating the luminance decrease ratio of the first color loading luminance by dividing a difference between the first color loading luminance and the black loading luminance by the black loading luminance;

calculating the luminance decrease ratio of the second color loading luminance by dividing a difference between the second color loading luminance and the black loading luminance by the black loading luminance;

calculating the luminance decrease ratio of the third color loading luminance by dividing a difference between the third color loading luminance and the black loading luminance by the black loading luminance;

calculating the first color scale factor by dividing the luminance decrease ratio of the white loading luminance by the luminance decrease ratio of the first color loading luminance;

calculating the second color scale factor by dividing the luminance decrease ratio of the white loading luminance by the luminance decrease ratio of the second color loading luminance; and calculating the third color scale factor by dividing the luminance decrease ratio of the white loading luminance by the luminance decrease ratio of the third color loading luminance.

7. The method of claim 6, wherein the first color, second color, and third color scale factors are obtained at a plurality of reference positions.

8. The method of claim 1, wherein the white, first color, second color, and third color loading luminances are obtained at a maximum gray level, and wherein the first color, second color, and third color scale factors are obtained at the maximum gray level.

9. The method of claim 1, wherein the white, first color, second color, and third color loading luminances are obtained at entire gray levels used in the display device, and wherein the first color, second color, and third color scale factors are obtained at the entire gray levels.

10. The method of claim 1, wherein the white, first color, second color, and third color loading luminances are obtained at a plurality of reference gray levels that is a portion of entire gray levels used in the display device, and wherein the first color, second color, and third color scale factors are obtained at the plurality of reference gray levels.

11. The method of claim 1, wherein when the input image data represents the single color image, the input image data is compensated using the first color, second color, and third color compensation value sets to which the first color, second color, and third color scale factors are not applied, and wherein when the input image data represents the mixed color image, the input image data is compensated using the first color, second color, and third color compensation value sets to which the first color, second color, and third color scale factors are respectively applied.

12. The method of claim 11, wherein the first color, second color, and third color scale factors are applied to the first color, second color, and third color compensation value sets by using an equation, "FINAL_COMP_VAL=1−((1−COMP_VAL)*SCALE_FACTOR)", and wherein COMP_VAL represents a compensation value in a corresponding one of the first color, second color, and third color compensation value sets, SCALE_FACTOR represents a corresponding one of the first color, second color, and third color scale factors, and FINAL_COMP_VAL represents the compensation value to which the corresponding one of the first color, second color, and third color scale factors is applied.

13. A method of operating a display device, the method comprising:

storing first color, second color, and third color compensation value sets and first color, second color, and third color scale factors;

receiving input image data;

determining whether the input image data represents a single color image or a mixed color image;

generating output image data by compensating the input image data using the first color, second color, and third color compensation value sets to which the first color, second color, and third color scale factors are not applied when the input image data represents the single color image;

generating the output image data by compensating the input image data using the first color, second color, and third color compensation value sets to which the first color, second color, and third color scale factors are respectively applied when the input image data represents the mixed color image, the first color, second color, and third color scale factors being applied to the first color, second color, and third color compensation value sets based on a compensation value in a corresponding one of the first color, second color, and third color compensation value sets; and displaying an image based on the output image data.

14. The method of claim 13, wherein the determining of whether the input image data represents the single color image or the mixed color image comprises:

determining that the input image data represents the single color image when the input image data comprises single color pixel data with respect to pixels of which a number is greater than or equal to a reference number; and determining that the input image data represents the mixed color image when the input image data comprises the single color pixel data with respect to pixels of which a number is less than the reference number.

15. The method of claim 13, wherein white, first color, second color, and third color loading luminances are obtained by capturing white, first color, second color, and third color loading patterns displayed by the display device, respectively, and wherein the first color, second color, and third color scale factors are calculated by dividing a luminance decrease ratio of the white loading luminance by luminance decrease ratios of the first color, second color, and third color loading luminances, respectively.

16. The method of claim 13, wherein the first color, second color, and third color scale factors are applied to the first color, second color, and third color compensation value sets by using an equation, "FINAL_COMP_VAL=1−((1−COMP_VAL)*SCALE_FACTOR)", wherein COMP_VAL represents the compensation value in a corresponding one of the first color, second color, and third color compensation value sets, SCALE_FACTOR represents a corresponding one of the first color, second color, and third color scale factors, and FINAL_COMP_VAL represents the compensation value to which the corresponding one of the first color, second color, and third color scale factors is applied.

17. A display device comprising:

a display panel comprising a plurality of pixels;

a data driver configured to provide data signals corresponding to output image data to the plurality of pixels;

a scan driver configured to provide scan signals to the plurality of pixels;

a compensation data storage configured to store first color, second color, and third color compensation value sets and first color, second color, and third color scale factors; and a controller configured to control the data driver and the scan driver, the controller comprising:

a single color image determiner configured to determine whether input image data represents a single color image or a mixed color image; and a data compensator configured to generate the output image data by compensating the input image data using the first color, second color, and third color compensation value sets to which the first color, second color, and third color scale factors are not applied when the input image data represents the single color image, and to generate the output image data by compensating the input image data using the first color, second color, and third color compensation value sets to which the first color, second color, and third color scale factors are respectively applied when the input image data represents the mixed color image, the first color, second color, and third color scale factors being applied to the first color, second color, and third color compensation value sets based on a compensation value in a corresponding one of the first color, second color, and third color compensation value sets.

18. The display device of claim 17, wherein the single color image determiner is configured to determine that the input image data represents the single color image when the input image data comprises single color pixel data with respect to pixels of which a number is greater than or equal to a reference number from among the plurality of pixels, and determine that the input image data represents the mixed color image when the input image data comprises the single color pixel data with respect to pixels of which a number is less than the reference number from among the plurality of pixels.

19. The display device of claim 17, wherein white, first color, second color, and third color loading luminances are obtained by capturing white, first color, second color, and third color loading patterns displayed by the display device, respectively, and wherein the first color, second color, and third color scale factors are calculated by dividing a luminance decrease ratio of the white loading luminance by luminance decrease ratios of the first color, second color, and third color loading luminances, respectively.

20. The display device of claim 17, wherein the first color, second color, and third color scale factors are applied to the first color, second color, and third color compensation value sets by using an equation, "FINAL_COMP_VAL=1−((1−COMP_VAL)*SCALE_FACTOR)", where COMP_VAL represents the compensation value in a corresponding one of the first color, second color, and third color compensation value sets, SCALE_FACTOR represents a corresponding one of the first color, second color, and third color scale factors, and FINAL_COMP_VAL represents the compensation value to which the corresponding one of the first color, second color, and third color scale factors is applied.

* * * * *